US011959155B2

(12) United States Patent
Yamori et al.

(10) Patent No.: US 11,959,155 B2
(45) Date of Patent: Apr. 16, 2024

(54) HEAT-RESISTANT MAGNESIUM ALLOY FOR CASTING

(71) Applicant: KURIMOTO, LTD., Osaka (JP)

(72) Inventors: Keisuke Yamori, Osaka (JP); Takeaki Miyamoto, Osaka (JP); Yasuhide Kanatsu, Osaka (JP); Akihiko Koshi, Osaka (JP); Masaaki Yamamoto, Osaka (JP); Jinsun Liao, Osaka (JP)

(73) Assignee: Kurimoto, LTD., Osaka (JP)

( * ) Notice: Subject to any disclaimer, the term of this patent is extended or adjusted under 35 U.S.C. 154(b) by 113 days.

(21) Appl. No.: 17/599,665

(22) PCT Filed: Mar. 6, 2020

(86) PCT No.: PCT/JP2020/009662
§ 371 (c)(1),
(2) Date: Sep. 29, 2021

(87) PCT Pub. No.: WO2020/203041
PCT Pub. Date: Oct. 8, 2020

(65) Prior Publication Data

US 2022/0205069 A1 Jun. 30, 2022

(51) Int. Cl.
*C22C 23/02* (2006.01)

(52) U.S. Cl.
CPC ..... *C22C 23/02* (2013.01)

(58) Field of Classification Search
CPC ..... C22C 23/02; C22C 23/00; B22D 21/007; C22F 1/06
USPC ..... 420/410
See application file for complete search history.

(56) References Cited

U.S. PATENT DOCUMENTS

| | | | | |
|---|---|---|---|---|
| 6,264,763 | B1 | 7/2001 | Powell et al. | |
| 6,719,857 | B2 * | 4/2004 | Ohori | B22D 21/007 420/407 |
| 2002/0020475 | A1 | 2/2002 | Sakamoto et al. | |

FOREIGN PATENT DOCUMENTS

| | | | | |
|---|---|---|---|---|
| EP | 990710 | A1 * | 4/2000 | B21J 5/00 |
| EP | 0990710 | A1 | 4/2000 | |
| JP | 2000104137 | A | 4/2000 | |
| JP | 2000319744 | A | 11/2000 | |
| JP | 2001316753 | A | 11/2001 | |
| JP | 3370009 | B2 | 1/2003 | |
| JP | 3415987 | B2 | 6/2003 | |
| JP | 2012077320 | A | 4/2012 | |
| JP | 2014001428 | A | 1/2014 | |

OTHER PUBLICATIONS

NPL: on-line translation of JP 2012077320 A1, Apr. 2012 (Year: 2012).*
Extended European Search Report dated Nov. 14, 2022; Application No. PCT/JP2020009662.
Nakata, T. et al., Effect of Si content on microstructures, tensile properties, and creep properties in a cast Mg-6Al-0.4Mn-2Ca (Wt.%) alloy, Materials Science & Engineering A, Jan. 27, 2020, vol. 776, pp. 1-9, ISSN 0921-5093 Experimental procedure, table 1, 2.
International Search Report dated Jun. 2, 2020; International Application No. PCT/JP2020/009662.

* cited by examiner

*Primary Examiner* — Jie Yang
(74) *Attorney, Agent, or Firm* — Dinsmore & Shohl LLP

(57) ABSTRACT

A magnesium alloy which has excellent tensile strength and elongation at a room temperature, as well as an excellent heat resistance represented by creep resistance is obtained. The magnesium alloy is produced which comprises 3.0% by mass or more and less than 6.0% by mass of Al, 0.10% by mass or more and 0.60% by mass or less of Mn, more than 0.50% by mass and less than 2.0% by mass of Ca, and more than 0.10% by mass and less than 0.40% by mass of Si, and has a balance composed of Mg and unavoidable impurities.

4 Claims, No Drawings

HEAT-RESISTANT MAGNESIUM ALLOY FOR CASTING

CROSS-REFERENCE TO RELATED APPLICATIONS

This application is the U.S. National Stage of PCT/JP2020/009662 filed Mar. 6, 2020, which claims priority to PCT Patent Application No. PCT/JP2019/014100, filed Mar. 29, 2019, the content of both are incorporated herein by reference in their entirety.

FIELD OF THE INVENTION

The present invention relates to a heat resistant magnesium alloy having excellent mechanical properties and corrosion resistance.

BACKGROUND OF THE INVENTION

Since magnesium alloys are lighter than steel materials and aluminum alloys, they are utilized as lightweight alternatives in various fields. As the magnesium alloy, an AZ-based alloy to which Al, Mn, and Zn are added and an AM-based alloy to which Al and Mn are added are known. In particular, for use in die casting, AZ91D (Mg-9% by mass of Al-1% by mass of Zn) having excellent strength and corrosion resistance at a room temperature is used as a general-purpose material for various applications. However, heat resistance (creep resistance) of a general-purpose magnesium alloy decreases in a high temperature range of about 175° C., and therefore heat resistance comparable to that of an aluminum alloy cannot be obtained.

As a method of improving creep resistance, a magnesium alloy to which Ca or RE (rare earth element) is added is known. As such an example, AE44 (Mg-4% mass of Al-4% mass of RE) having excellent creep resistance, or the like is used.

Furthermore, in recent years, Mg—Al—Ca-based alloys having improved creep resistance without comprising expensive RE have been proposed. For example, in Patent Document 1, a semi-solid injection molded magnesium alloy has been proposed as a heat resistant magnesium alloy having particularly excellent moldability and elongation while securing creep resistance, which comprises 2 to 6% by mass of aluminum and 0.5 to 4% by mass of calcium, has a balance composed of magnesium and unavoidable impurities, and has a Ca/Al ratio of 0.8, preferably 0.6 or less.

Moreover, in Patent Document 2, a magnesium alloy has been proposed as a light metal having good creep resistance and excellent forgeability in producing a light metal member by semi-solid injection molding, which comprises 2% by mass or more and 6% by mass or less of aluminum and 0.5% by mass or more and 4% by mass or less of calcium.

Here, the semi-solid injection molding process is a process wherein a material that has been in a solid-liquid coexisting state by heating is injected into a mold by pressurizing and molded. Such semi-solid processing is more expensive than ordinary casting. Moreover, quality deterioration under a low temperature environment with a high solid phase rate becomes a problem. Specific examples of this quality deterioration include deterioration in flow ability, resulting in frequent occurrence of misrun.

PRIOR ART DOCUMENT

Patent Document

Patent Document 1: JP 3415987 B
Patent Document 2: JP 3370009 B

SUMMARY OF THE INVENTION

However, there has still been a demand for a magnesium alloy which is excellent in mechanical properties including not only elongation but also tensile strength at a room temperature, and in heat resistance represented by creep resistance, and further in corrosion resistance, which has been required. Moreover, a casting magnesium alloy which is suitable for die casting or the like which is excellent in quality, mass productivity, and cost, instead of semi-solid injection molding, has been desired.

Therefore, it is an object of the present invention to obtain a magnesium alloy having excellent mechanical properties at a room temperature, heat resistance, and corrosion resistance.

Means to Solve the Problem

The present invention has solved the above-described problems with magnesium alloy comprising 3.0% by mass or more and less than 6.0% by mass of Al, 0.10% by mass or more and 0.60% by mass or less of Mn, more than 0.50% by mass and less than 2.0% by mass of Ca, and more than 0.10% by mass and less than 0.40% by mass of Si, and having a balance composed of Mg and unavoidable impurities.

Moreover, among the above-described magnesium alloys, a magnesium alloy comprising 4.5% by mass or more and less than 6.0% by mass of Al tends to exhibit more excellent mechanical properties.

Furthermore, among the above-described magnesium alloys, a magnesium alloy comprising 0.90% by mass or more and less than 2.0% by mass of Ca tends to exhibit a further excellent heat resistance.

Effects of the Invention

The magnesium alloy according to the present invention exhibits excellent mechanical properties at a room temperature, heat resistance, and corrosion resistance, can improve functions of various products, and further can be applied to die casting which is excellent in mass productivity and cost.

EMBODIMENT FOR CARRYING OUT THE INVENTION

Hereinafter, the present invention will be described in detail.

i. The Present Invention is a Magnesium Alloy Comprising at Least Al, Mn, Ca, and Si.

The magnesium alloy according to the present invention needs to have an Al content of 3.0% by mass or more, preferably 4.5% by mass or more. When the Al content is less than 3.0% by mass, tensile strength becomes too low. When the Al content is 4.5% by mass or more, tensile strength becomes easy to be stably secured. Moreover, an effect of improving strength by solute strengthening and improvement in castability are also expected by comprising Al. Furthermore, improvement in heat resistance is also expected by forming a compound of Al with Ca. On the other hand, the Al content needs to be less than 6.0% by mass. When the Al content is 6.0% by mass or more, elongation becomes too low. In addition, a $Mg_{17}Al_{12}$ phase is crystallized, which may significantly lower heat resistance.

The magnesium alloy according to the present invention needs to have an Mn content of 0.10% by mass or more, preferably 0.20% by mass or more. Owing to comprising Mn, when Fe is contained as an unavoidable impurity, de-ironing effect is exhibited by forming an Al—Fe—Mn-based compound, and an alloy as a whole is expected to be improved in corrosion resistance. Moreover, a crystal grain is expected to be refinement owing to comprising Mn. When the Mn content is less than 0.10% by mass, there is a high possibility that these effects cannot be sufficiently exhibited. On the other hand, the Mn content needs to be 0.60% by mass or less, preferably 0.50% by mass or less. When Mn is excessively comprised in excess of 0.60% by mass, a large amount of coarse Al—Mn-based compounds are crystallized, which increases possibility of leading to deterioration in mechanical properties.

The magnesium alloy according to the present invention needs to have a Ca content of more than 0.50% by mass, and it preferably has a Ca content of 0.90% by mass or more. Flame retardancy of a molten metal during casting is improved by adding Ca, though the effect becomes insufficient when the Ca content is 0.50% by mass or less. Moreover, a compound is formed between Ca and Al, and this compound contributes to heat resistance. When the Al content is relatively high, i.e., 4.5% by mass or more, a sufficient amount of an intermetallic compound is formed, so that the Ca content is preferably 0.90% by mass or more. On the other hand, the Ca content needs to be less than 2.0% by mass, preferably 1.8% by mass or less. When the Ca content is 2.0% by mass or more, tensile strength, elongation, and corrosion resistance become easy to have problems. Furthermore, excessive Ca content may lead to occurrence of cracks and exacerbation of soldering during casting.

The magnesium alloy according to the present invention needs to have a Si content of more than 0.10% by mass. A Mg—Ca—Si compound is formed between Si and Ca, which is expected to improve heat resistance, but when the content is less than 0.10% by mass, this effect is not sufficiently exhibited. On the other hand, the Si content needs to be less than 0.40% by mass. When Si is excessively comprised, the above-mentioned Mg—Ca—Si compound is coarsely crystallized, and there is a high possibility that the toughness is lowered.

The magnesium alloy according to the present invention may comprise unavoidable impurities in addition to the above-mentioned elements. These unavoidable impurities are unavoidably comprised against intention due to a manufacturing problem or a problem on a raw material. Examples of the unavoidable impurities include, for example, elements such as Ti, Cr, Fe, Ni, Cu, Sr, Zr, Be, Ba, and RE (rare earth elements). All of the elements need to have a content within a range that does not impede characteristics of the magnesium alloy according to the present invention, and they preferably have a content of less than 0.1% by mass, respectively, preferably have as little content as possible, particularly preferably have a content below a detection limit. Moreover, a total content of unavoidable impurities is preferably less than 0.5% by mass, more preferably less than 0.2% by mass, further preferably less than 0.1% by mass, particularly preferably below a detection limit.

The magnesium alloy according to the present invention can be prepared by a general method using a raw material comprising the above-mentioned elements so as to be in the ranges of the above-mentioned % by mass. Besides, the above-mentioned % by mass are not values in the above-mentioned raw material, but values in a prepared alloy or a product obtained by producing the alloy by casting, etc.

The magnesium alloy according to the present invention has excellent tensile strength and elongation at a room temperature, as well as an excellent heat resistance represented by creep resistance, and further, an excellent corrosion resistance. Moreover, it can be used for production in the similar procedure as a general-purpose material of a magnesium alloy, and in particular, it can be appropriately used for applications requiring excellent mechanical properties at a room temperature, excellent heat resistance, and excellent corrosion resistance. Therefore, a cast structural member having excellent mechanical properties, heat resistance, and corrosion resistance can be obtained by die casting which is excellent in mass productivity and cost, instead of semi-solid injection molding.

EXAMPLE

An example of actually preparing the magnesium alloy according to the present invention is shown. The magnesium alloy was prepared so that components of elements other than Mg have % by mass of contents described in Table 1 below, respectively, to prepare an alloy material based on d "collection of test materials required for producing a tensile test piece" of JIS H 5203 "8. Inspection" (corresponding to ISO16220-5). That is, test materials were collected from the magnesium alloy adjusted to have % by mass of contents described in Table 1, respectively, by a gravity casting method. Besides, elements other than the elements described were below a detection limit.

Each alloy was tested based on the tensile test method specified in JIS Z 2241 (corresponding to ISO6892-1). A test sample was produced by machining the above-described alloy material to measure tensile strength and elongation using a universal tester (UH-500kNX manufactured by Shimadzu Corporation) as a tester.

Moreover, a test was conducted based on the creep test method specified in JIS Z 2271 (corresponding to ISO204: 2009). A test sample was produced by machining the above-described alloy material to measure a creep strain (%) after 100 hours under a test temperature at 175° C. and an applied stress of 50 MPa using SK-3 manufactured by Sinkou Kagaku Kikai Co., LTD. as a creep tester.

Furthermore, a test was conducted based on the salt spray test method specified in JIS Z 2371 (corresponding to ISO 9227: 2012). A test sample was prepared by being molded by gravity casting and then machined. A test was conducted for 96 hours by a neutral salt spray test as a test method using a tester manufactured by Suga Test Instruments Co., Ltd. After the test, the test sample was boiled in a mixed aqueous solution of chromium (VI) oxide and silver nitrate for 1 minute to remove corrosion products, and a corrosion weight loss was measured.

Table 1 below shows tensile strength, elongation, creep strain, and overall evaluation, as well as a component ratio of each test sample. As evaluations, from the worst, "B" shall be Bad, "G" be Good, and "VG" be Very Good. For tensile strength, less than 150 MPa was evaluated as "B", 150 MPa or more and less than 170 MPa as "G", and 170

MPa or more as "VG". For elongation, less than 3.5% was evaluated as "B", 3.5% or more and less than 4.0% as "G", and 4.0% or more as "VG". For creep strain, more than 0.25% was evaluated as "B", more than 0.18% and 0.25% or less as "G", and 0.18% or less as "VG". For the above-mentioned three items, when there was one or more "B", the overall evaluation was scored as "B". When there was "G" or "VG" for all items, without including "B", the overall evaluation was scored as "G". Furthermore, when all the items were scored as "VG", the overall evaluation was scored as "VG".

| No. | Component (unit: % by mass) | | | | | Tensile strength | | Elongation | | Creep strain | | Overall |
|---|---|---|---|---|---|---|---|---|---|---|---|---|
| | Mg | Al | Mn | Ca | Si | MPa | | % | | % | | evaluation |
| Example 1 | Bal. | 3.47 | 0.38 | 0.81 | 0.14 | 169 | G | 7.8 | VG | 0.13 | VG | G |
| Example 2 | Bal. | 3.59 | 0.33 | 1.76 | 0.14 | 150 | G | 3.5 | G | 0.03 | VG | G |
| Example 3 | Bal. | 3.89 | 0.31 | 1.80 | 0.36 | 160 | G | 4.2 | VG | 0.07 | VG | G |
| Example 4 | Bal. | 4.03 | 0.31 | 1.09 | 0.20 | 166 | G | 6.9 | VG | 0.08 | VG | G |
| Example 5 | Bal. | 4.15 | 0.28 | 1.32 | 0.20 | 153 | G | 3.8 | G | 0.07 | VG | G |
| Example 6 | Bal. | 4.57 | 0.35 | 0.82 | 0.33 | 170 | VG | 6.1 | VG | 0.22 | G | G |
| Example 7 | Bal. | 4.67 | 0.21 | 1.26 | 0.22 | 175 | VG | 4.9 | VG | 0.08 | VG | VG |
| Example 8 | Bal. | 5.55 | 0.34 | 0.64 | 0.13 | 204 | VG | 9.0 | VG | 0.19 | G | G |
| Example 9 | Bal. | 5.71 | 0.36 | 1.09 | 0.29 | 177 | VG | 5.1 | VG | 0.16 | VG | VG |
| Example 10 | Bal. | 5.74 | 0.26 | 0.96 | 0.19 | 171 | VG | 4.5 | VG | 0.17 | VG | VG |
| Example 11 | Bal. | 5.97 | 0.33 | 1.33 | 0.31 | 175 | VG | 4.2 | VG | 0.14 | VG | VG |
| Comparative Example 1 | Bal. | 2.00 | 0.18 | 1.15 | 0.18 | 131 | B | 3.1 | B | 0.08 | VG | B |
| Comparative Example 2 | Bal. | 6.10 | 0.30 | 1.83 | 0.40 | 151 | G | 2.3 | B | 0.11 | VG | B |
| Comparative Example 3 | Bal. | 4.27 | 0.29 | 2.97 | 0.22 | 133 | B | 0.8 | B | 0.07 | VG | B |
| Comparative Example 4 | Bal. | 3.24 | 0.22 | 1.84 | 0.42 | 141 | B | 2.2 | B | 0.06 | VG | B |
| Comparative Example 5 | Bal. | 5.97 | 0.32 | 2.40 | 0.56 | 149 | B | 2.0 | B | 0.07 | VG | B |
| Comparative Example 6 | Bal. | 8.73 | 0.28 | 0.87 | 0.20 | 165 | G | 2.3 | B | 0.26 | G | B |

In Comparative Example 1 in which the Al content was insufficient, both tensile strength and elongation were insufficient. On the other hand, in Comparative Examples 2 and 6 in which the Al content was excessive, elongation was deteriorated. In Comparative Examples 3 and 5 in which the Ca content was excessive, there were problems in both elongation and tensile strength. In Comparative Examples 4 and 5 in which the Si content was excessive, there were also problems in both elongation and tensile strength.

All of Examples 1 to 5 were evaluated as "G" or higher, but in Examples 6 to 11 in which the Al content was further increased as compared with Examples 1 to 5, it was confirmed that tensile strength was improved. However, among Examples 6 to 11 in which the Al content was increased, in Examples 6 and 8 in which the Ca content was slightly insufficient, evaluation of creep strain remained at "G". Meanwhile, among Examples 6 to 11, in Examples 7, 9, 10, and 11 having a large Ca content, evaluation of creep strain was scored as "VG".

Table 2 below shows a corrosion weight loss, as well as a component ratio in each test sample.

TABLE 2

| | Component (% by mass) | | | | | Corrosion weight loss |
|---|---|---|---|---|---|---|
| | Mg | Al | Mn | Ca | Si | (mcd) |
| Example 12 | Bal. | 4.83 | 0.39 | 1.30 | 0.26 | 0.48 |
| Example 13 | Bal. | 5.03 | 0.43 | 1.79 | 0.27 | 1.17 |

TABLE 2-continued

| | Component (% by mass) | | | | | Corrosion weight loss |
|---|---|---|---|---|---|---|
| | Mg | Al | Mn | Ca | Si | (mcd) |
| Example 14 | Bal. | 3.69 | 0.32 | 1.15 | 0.27 | 2.89 |
| Example 15 | Bal. | 4.04 | 0.33 | 1.49 | 0.28 | 3.31 |
| Comparative Example 7 | Bal. | 4.13 | 0.30 | 2.08 | 0.31 | 5.11 |

As shown in Table 2, Examples 12 to 15 show a good corrosion resistance of less than 5.00 mcd (mg/cm$^2$/day). However, in Comparative Example 7, corrosion resistance was 5.11 mcd, which was not sufficient. It is considered that this is because the Ca content was excessive and therefore corrosion resistance was deteriorated.

The invention claimed is:

1. A die cast magnesium alloy comprising:

a composition consisting of:

4.5% by mass or more and less than 6.0% by mass of Al, 0.10% by mass or more and 0.60% by mass or less of Mn, more than 0.9% by mass and less than 2.0% by mass of Ca, more than 0.10% by mass and less than 0.40% by mass of Si, and a balance of Mg and unavoidable impurities;

a tensile strength greater than or equal to 171 MPa, measured in accordance with ISO 6892-1;

an elongation greater than or equal to 4.2%, measured in accordance with ISO 6892-1; and a creep strain of less than or equal to 0.17%, measured in accordance with ISO 204:2009 after 100 hours at 175° C. under an applied stress of 50 MPa.

2. The die cast magnesium alloy of claim 1, wherein elements of the unavoidable impurities respectively form less than 0.1% by mass of the magnesium alloy.

3. A method for manufacturing a die cast magnesium alloy, the method comprising:

preparing a magnesium alloy composition to consist of:

4.5% by mass or more and less than 6.0% by mass of Al, 0.10% by mass or more and 0.60% by mass or less of Mn, more than 0.9% by mass and less than 2.0% by mass of Ca, more than 0.10% by mass and less than 0.40% by mass of Si, and a balance of Mg and unavoidable impurities; and die casting the magnesium alloy composition to form the die cast magnesium alloy, wherein the die cast magnesium alloy comprises:

a tensile strength greater than or equal to 171 MPa, measured in accordance with ISO 6892-1;

an elongation greater than or equal to 4.2%, measured in accordance with ISO 6892-1; and a creep strain of less than or equal to 0.17%, measured in accordance with ISO 204:2009 after 100 hours at 175° C. under an applied stress of 50 MPa.

4. The method of claim 3, wherein elements of the unavoidable impurities respectively form less than 0.1% by mass of the magnesium alloy.

* * * * *